United States Patent [19]

Hamaguchi et al.

[11] Patent Number: 4,598,865

[45] Date of Patent: Jul. 8, 1986

[54] SPRAYER CAP STRUCTURE

[75] Inventors: Masami Hamaguchi, Ohsaka; Toshio Taguchi, Yokohama; Takamitsu Nozawa; Riichi Ogawa, both of Tokyo, all of Japan

[73] Assignees: Siseido Co., Ltd.; Yoshino Kogyosho Co., Ltd., both of Tokyo, Japan

[21] Appl. No.: 659,299

[22] Filed: Oct. 10, 1984

[30] Foreign Application Priority Data

Oct. 24, 1983 [JP] Japan ..... 58-164463[U]
Dec. 5, 1983 [JP] Japan ..... 58-187597[U]
Mar. 1, 1984 [JP] Japan ..... 59-30072[U]

[51] Int. Cl.[4] ..... B05B 7/30; A62C 31/00; B65D 1/32; B65D 37/00

[52] U.S. Cl. ..... 239/342; 239/327; 239/444; 222/212; 222/553

[58] Field of Search ..... 239/327, 342, 444; 222/211, 212, 402.19, 484, 486, 553; 285/24, 27, 282; 403/345

[56] References Cited

U.S. PATENT DOCUMENTS

| | | | |
|---|---|---|---|
| 2,275,051 | 3/1942 | Maloney | 222/212 X |
| 2,989,251 | 6/1961 | Abplanalp | 239/337 X |
| 3,118,578 | 1/1964 | Collins | 222/212 X |
| 3,403,828 | 10/1968 | Frank | 222/486 |
| 3,572,590 | 4/1971 | Malone | 239/327 |
| 4,122,979 | 10/1978 | Laawe | 222/211 X |
| 4,376,497 | 4/1983 | Mumford | 222/553 X |
| 4,401,270 | 8/1983 | McKinney | 239/327 |

FOREIGN PATENT DOCUMENTS

| | | | |
|---|---|---|---|
| 8202607 | 8/1983 | France | 222/402.13 |
| 578764 | 7/1958 | Italy | 239/327 |

*Primary Examiner*—Jeffrey V. Nase
*Assistant Examiner*—Patrick N. Burkhart
*Attorney, Agent, or Firm*—Parkhurst & Oliff

[57] ABSTRACT

This invention relates to an improved sprayer cap structure associated with a neck portion of a bottle-shaped container for providing a liquid spraying operation or a liquid streaming operation. The sprayer cap includes an inner plug integrally formed adjacently with first and second hollow cylindrical portions in a top-walled cylindrical section. The cylindrical section is perforated with a first hole communicating with the bottom of the container through a pipe, and is also formed with a first valve chamber provided with a blocking valve at the upper position thereof and with a check valve at the lower position thereof. The cylindrical section further is perforated with a second hole and a third hole spaced longitudinally, and formed with a second valve chamber under the second hole, the second valve chamber being provided with a blocking valve at the upper position thereof. A nozzle unit is formed with a spinner slot capable of communicating with the first and second holes of the inner plug. The nozzle unit is perforated with a first nozzle hole substantially at the center of the spinner slot of the inner cylindrical section, and further perforated with a second nozzle hole capable of communicating the third hole of the inner plug adjacent to the first nozzle hole. A cylindrical cover unit is associated immovably with the container body.

23 Claims, 26 Drawing Figures

SPRAYER CAP STRUCTURE

BACKGROUND OF THE INVENTION

This invention relates to a sprayer cap structure and, more particularly, to a sprayer cap capable of reliably simplifying the switching operation between a spraying and a streaming of fluid or liquid.

There is a certain type of a sprayer cap structure for spraying liquid in a bottle-shaped container called a squeeze sprayer. This squeeze sprayer sprays and atomizes the liquid in the container by deforming or squeezing the container body to enhance the internal pressure of the container.

However, this squeeze sprayer not only sprays the liquid in the container body but liquid necessarily flows out or streams in the body as required according to the using state.

In this case, it is desired to allow a sprayer cap to be able to both spray or atomize and stream liquid in a container body. It is further required in the sprayer cap to simply switch between the spraying and the streaming with stable directivity as well as to readily and reliably operate the spraying and the streaming In view of such requirements in the sprayer cap, it is considered to prepare a sprayer cap of te structure in which an inner plug is perforated with a first hole communicating with the bottom of a bottle-shaped container through a pipe for injecting liquid and with a second hole merely communicating within a container body as an air hole. The inner plug is associated rotatably with a nozzle unit formed with spinner grooves made on the inner peripheral surface and perforated with a nozzle hole.

This sprayer cap sprays liquid from the nozzle hole by inwardly pressing or squeezing the container body in the state that the first and second holes are positioned relative to the spinner grooves to increase the internal pressure thereby injecting the liquid from the first hole and the air from the second hole. The sprayer cap streams the liquid by communicating only between the second hole and the nozzle hole, inverting the container body upside down and increasing the internal pressure.

However, in such conventional sprayer cap structure, there arise problems such that, if the container body is excessively inclined particularly in the spraying state, the liquid is injected from the second hole as the air hole, thereby disabling effective spraying action. Alternatively, if the liquid level in the pipe decreases especially if the remaining liquid excessively decreases, a high internal pressure is required to inject the liquid from the first hole, so that the container body should be strongly deformed and squeezed, with the result that, even if the body is squeezed to an allowable degree, sufficient internal pressure cannot be obtained in the body in some cases.

SUMMARY OF THE INVENTION

Accordingly it is an object of the present invention to provide a sprayer cap structure which can eliminate all the disadvantages of the conventional sprayer cap and can reliably simplify the switching operation between a spraying or atomizing and a streaming of liquid.

The present invention provides an improved sprayer cap structure associated with a neck portion of a soft synthetic resin bottle-shaped container. The spray cap comprises an inner plug integrally formed adjacently with first and second hollow cylindrical portions in a top-walled cylindrical section. The cylindrical section is perforated with a first hole communicating with the bottom of the container through a pipe engaged with the lower end thereof from the first cylindrical portion ot the top-walled cylindrical section, and also formed with a first valve chamber provided with a blocking valve at the upper position thereof by a first ball valve and with a check valve at the lower position thereof. Further, the cylindrical section is perforated with a second hole and a third hole spaced longitudinally from the second cylindrical portion to the top-walled cylindrical section, and formed with a second valve chamber under the second hole, the second valve chamber being provided with a blocking valve by a second ball valve at the upper position thereof. A nozzle unit is formed with a spinner slot capable of communicating with the first and second holes of the inner plug on the inner surface of a top-walled inner cylindrical section rotatably and non-telescopically associated with the inner plug. The nozzle unit is perforated with a first nozzle hole substantially at the center of the spinner slot of the inner cylindrical section, and further perforated with a second nozzle hole capable of communicating with the third hole of the inner plug adjacent to the first nozzle hole. A cylindrical cover unit is associated at the lower end thereof immovably with the container body to sheath the inner cylindrical section of the nozzle unit, and formed with a window hole for exposing the first and second nozzle holes of the nozzle unit. The peripheries of the first, second and third holes perforated at the outer peripheral wall of the inner plug are intimately contacted with the inner peripheral surface of the inner cylindrical section of the nozzle unit.

BRIEF DESCRIPTION OF THE DRAWINGS

The foregoing objects and other objects as well as the characteristic features of the invention will become more fully apparent and more readily understandable by the following description and the appended claims when read in conjunction with the accompanying drawings, wherein:

DESCRIPTION OF THE PREFERRED EMBODIMENTS

Embodiments of a sprayer cap structure constructed according to the present invention will now be described in more detail with reference to the accompanying drawings.

Figure 1:
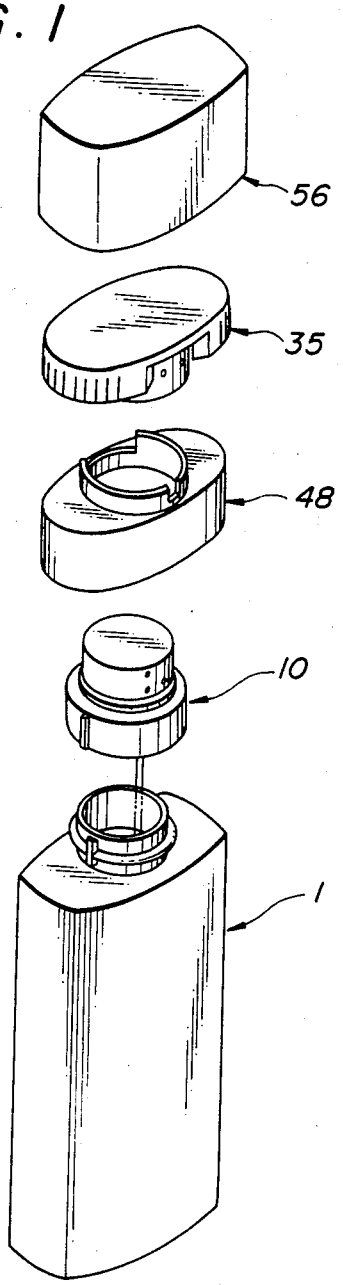
FIG. 1 is an exploded perspective view showing an embodiment of a sprayer cap structure constructed according to the present invention.
Figure 2:
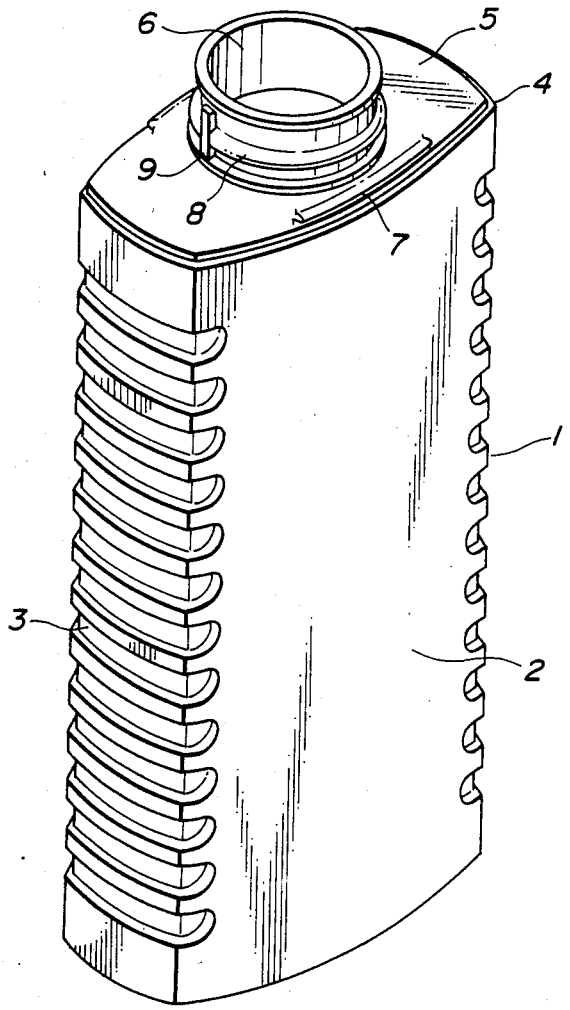
FIG. 2 is a perspective view of a bottle-shaped container employing the sprayer cap of the invention.

Referring to FIGS. 1 and 2, showing one preferred embodiment of the sprayer cap structure according to the present invention, wherein like reference numerals designate the same or equivalent parts in the following views, reference numeral 1 designates a bottle-shaped container formed of soft synthetic resin. The container 1 in the embodiment of the drawings is formed in substantially elliptical cross-sectional linear cylindrical shape, and is inwardly elastically deformable upon appication of an external force to a container body 2 thereof without elongation deformation. In order to further facilitate the deformation of the container body 2, grooved parts 3 having a number of threads longitudinally spaced at a predetermined equal interval are formed partly along the both longitudinal opposite sides of the container body 2.

The container body 2 is integrally formed at the upper end thereof with a top wall 5 through a stepped part 4 formed over the entire periphery of the top wall 5. A short cylindrical neck portion 6 stands upwardly substantially at the center of the top wall 5. When the short-diameter direction of the substantially elliptical shape of the top wall 5 is represented as the lateral forward and backward direction of the container 1, engaging strips 7 are respectively formed on the front end and the rear end on the upper surface of the top wall 4, undercut outer threads 8 are circumferentially formed on the outer peripheral surface of the neck portion 6 substantially at the center, and a pair of engaging longitudinal strips 9 are further formed on the outer peripheral surface of the neck portion 6 on the imaginary long-diameter line of the top wall 5. The strips 9 extend upwardly on the neck portion 6 to a height substantially equal to the height of the threads 8 on the neck portion 6.

Figure 3A:
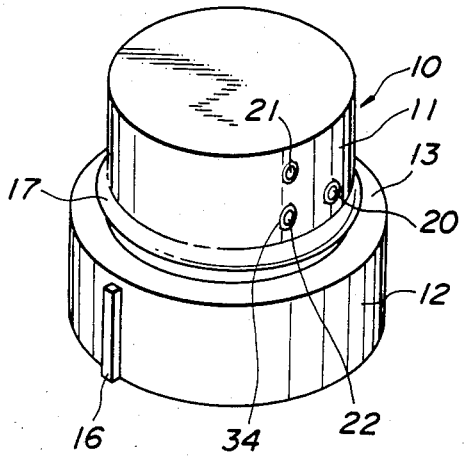
FIGS. 3*a* and 3*b* are perspective views of an inner plug of the sprayer cap of the invention.
Figure 3B:
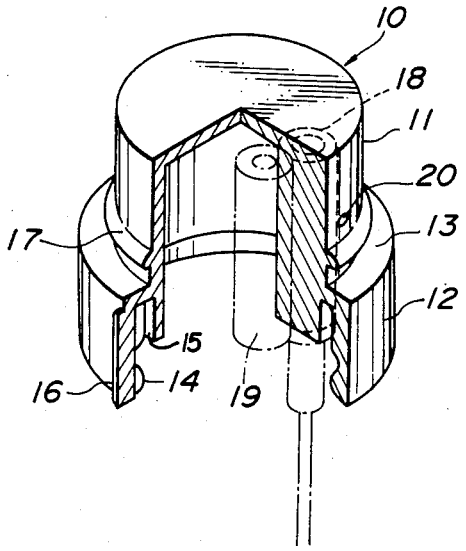

Referring now to FIGS. 1 and 3*a*, 3*b*, reference numeral 10 designates an inner plug of a top-walled cylindrical shape immovably associated with the neck portion 6 of the container 1.

More particularly, the outer diameter of the top-walled small-diameter cylindrical section 11 of the inner plug 10 is substantially equal to the inner diameter of the neck portion 6. An outer large-diameter cylindrical section 12 having an inner diameter substantially equal to the outer diameter of the neck portion 6 is integrally suspended from the outer periphery of the lower end of the cylindrical section 11 through an annular collar 13. Further, undercut inner threads 14 to be engaged with the outer threads 8 of the neck portion 6 are circumferentially formed on the lower inner peripheral surface of the cylindrical section 12, and engaging longitudinal stopper groove 15 is formed in a manner for cutting out the inner threads 14 corresponding to the longitudinal strip 9 of the neck portion 6.

When the lower portion of the cylindrical section 11 is inserted into the neck portion 6 and the cylindrical section 12 is sheathed on the neck portion 6, the outer threads 8 and the inner threads 14 are elevationally engaged, the longitudinal strip 9 and the longitudinal groove 15 are circumferentially engaged, and the plug unit 10 is then associated intimately and immovably with the neck portion 6.

Longitudinal outer strips 16 are formed at two positions corresponding to the inner stopper grooves 15 on the outer peripheral surface of the cylindrical section 12, and outer peripheral threads 17 are formed at the position slightly above the collar 13 on the outer periphery of the cylindrical section 11.

In the cylindrical section 11 of the inner plug 10 thus constructed in the embodiment exemplified in the drawings, a pair of longitudinal hollow cylindrical portions 18 and 19 are formed in an adjacent relationship at an attitude integrally formed or attached with the inner peripheral surface of the cylindrical section 11.

A first hole 20 is perforated substantially from the center of the first cylindrical portion 18 over to the wall of the cylindrical section 11, a second hole 21 is also perforated from the upper end of the second cylindrical portion 19 over to the wall of the cylindrical section 11, and a third hole 22 is perforated elevationally in space from the second hole 21 circumferentially in the same height as the first hole 20 at the wall of the cylindrical section 11.

Figure 4:
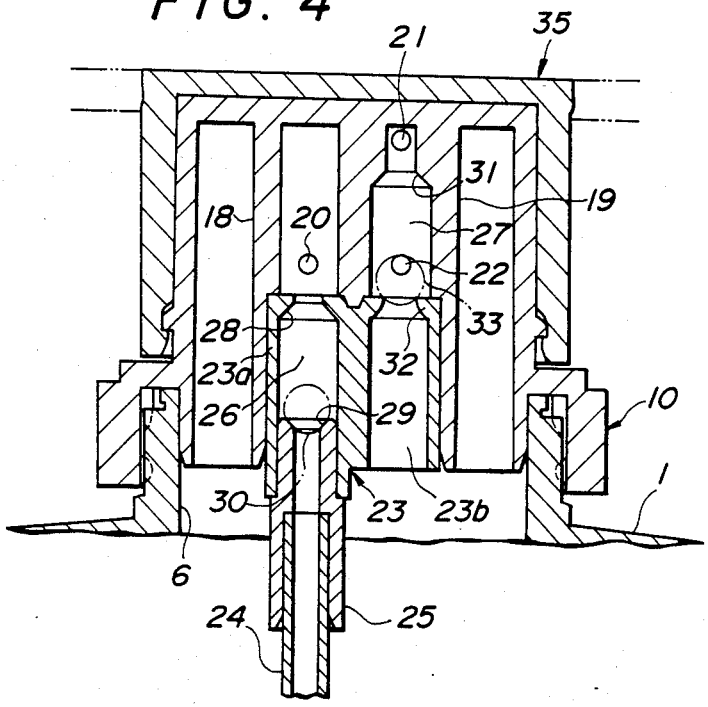
FIG. 4 is a sectional view showing the essential part of the interior of the inner plug.

In the embodiment exemplified particularly in FIG. 4, a valve cylinder 23 consisting of a pair of cylindrical bores 23*a* and 23*b* is commonly engaged intimately with the lower portions of the first and second cylindrical portions 18 and 19 adjacent the first and third holes 20, 22. A pipe 24 extends to the bottom of the container 1 and is engaged intimately with a valve seat cylindrical portion 25, which is engaged with the lower portion of the valve cylinder 23 communicating with the first cylindrical portion 18. A first valve chamber 26 is formed in the lower part of the first cylindrical portion 18, and a second valve chamber 27 is formed in the upper part of the second cylindrical portion 19.

In the first valve chamber 26, a blocking valve seat 28 is formed on the upper end of one cylindrical bore 23*a* of the valve cylinder 23 as the upper end thereof. A check valve seat 29 on the upper end of the cylindrical portion 25 is engaged with one cylindrical bore 23*a* of the lower end thereof. A ball valve 30 is contained in the valve chamber 26. In the second valve chamber 27, a blocking valve seat 31 is formed at the position slightly below the second hole 21 in the upper part of the second cylindrical portion 19. A holding portion 32 is formed on the upper end of the other cylindrical bore 23*b* of the valve cylinder 23. A ball valve 33 is contained between the blocking valve seat 31 and the holding portion 32 in the second valve chamber 27.

Figure 4A:
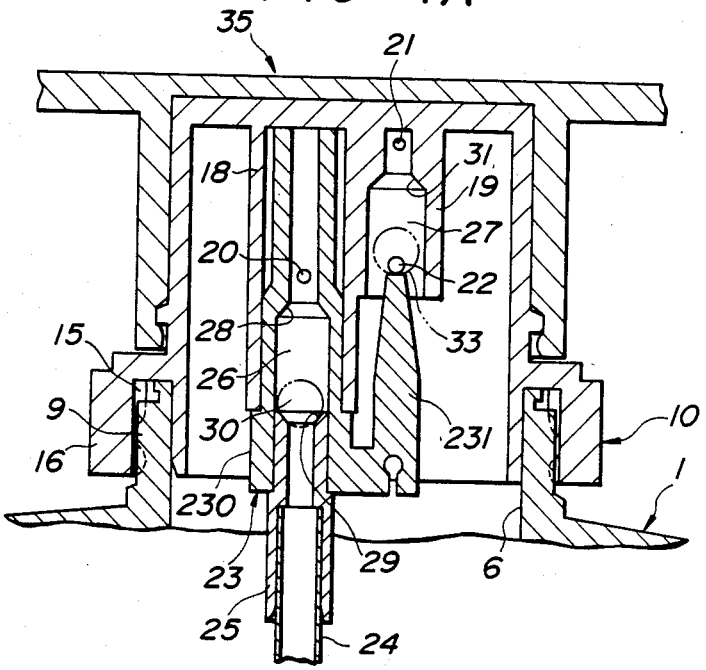
FIG. 4A is a sectional view showing a modified example of the inner plug according to the invention.

Further, as a modified example of the inner plug exemplified in FIG. 4A, a valve cylinder 23 is associated in a first longitudinal cylindrical portion 18 having a length longer than a second longitudinal cylindrical portion 19. This valve cylinder 23 consists of a cylindrical portion 230 intimately engaged within the first cylindrical portion 18, and a holding portion 231 movably engaged within the lower portion of the second cylindrical portion 19. A first valve chamber 26 is formed in the first cylindrical portion 18, and a second valve chamber 27 is formed in the second cylindrical portion 19.

More specifically, a block valve seat 28 is formed at a position disposed lower than the first hole 20 in the cylindrical portion 230 and communicates with the first hole 20 cut out at the upper end. A check valve seat 29 is formed on the upper end of a valve seat cylindrical portion 25 and intimately engaged within the lower part of the cylindrical portion 230. A ball valve 30 is arranged between the blocking valve seat 28 and the check valve seat 29 in the first valve chamber 26, and a pipe 24 extending to the bottom of the container 1 is intimately engaged with the lower portion of the cylindrical portion 25.

Further, a blocking valve seat 31 is formed at a position slightly below the second hole 21 in the second cylindrical portion 19, and a second valve chamber 27 is formed to contain a ball valve 33 between the blocking valve seat 31 and a holding portion 231 disposed at the lower position of the third hole 22.

In the inner plug 10 thus constructed, the holes 20, 21 and 22 are formed at the neck portion 6 toward the front side of the container 1, and sealing strips 34 are respectively provided at the peripheries of the holes 20, 21 and 22.

Figure 5A:
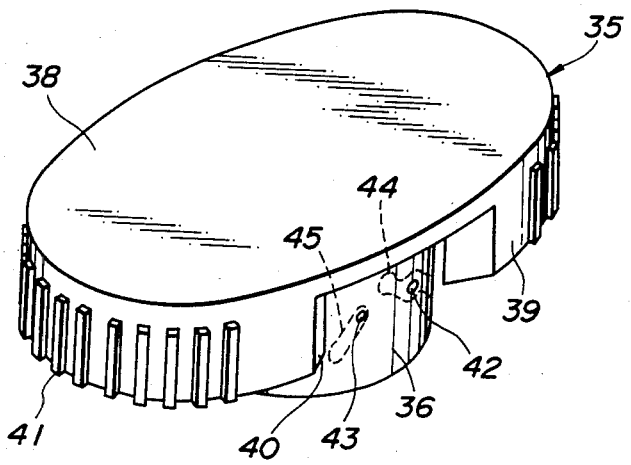
FIGS. 5*a* and 5*b* are perspective views of a nozzle unit of the sprayer cap of the invention.
Figure 5B:
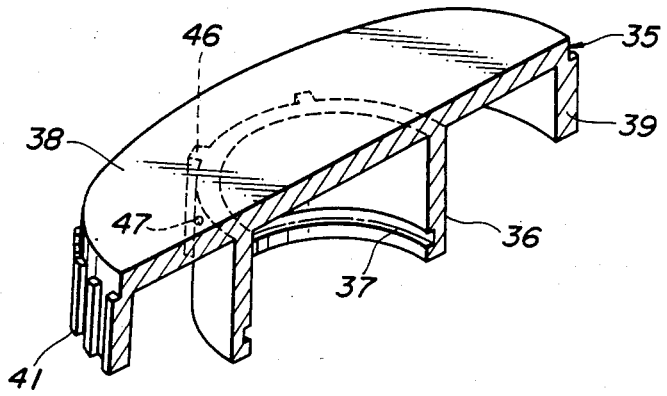

Referring now to FIGS. 1 and 5*a*, 5*b*, reference numeral 35 designates a nozzle unit of a top-walled elliptical cylindrical shape. An inner peripheral groove 37 is formed on the lower part of the inner peripheral surface of a top-walled inner cylindrical section 36 and has an inner diameter substantially equal to the outer diameter of the plug unit 10. When the outer threads of the inner plug 10 are engaged with the inner groove 37 of the nozzle unit 35, the nozzle unit 35 is associated rotatably but non-telescopically with the plug unit 10.

a top wall or plate 38 of the nozzle unit 35 is formed in an elliptical shape substantially equal to the top wall 5 of a bottle-shaped container 1, and the inner cylindrical section 36 is suspended integrally from the lower center of the top wall 38. An outer peripheral wall 39 is suspended integrally from the peripheral edge of the top wall 38 of the nozzle unit 35. The front side of the outer peripheral wall 39 is cut out from the upper end to the lower end in a predetermined lateral width to form a cut-out portion 40, and knurled sides 41 are partly formed oppositely on the outer peripheral surface of the outer peripheral wall 39.

The first and second nozzle holes 42 and 43 are spaced at a predetermined interval at the same height on the front part of the cylindrical section 36, and are exposed through the cut-out portion 40 of the outer peripheral wall 39.

The positions of the nozzle holes 42, 43 in height are disposed substantially in the intermediate area between the second hole 21 and the third hole 22 of the inner plug 10 when the nozzle unit 35 is associated with the inner plug 10.

As particularly exemplified in FIGS. 5*a*, 5*b* and 8*a*, 8*b* and 8*c*, a spinner slot 44 is formed substantially at the center of the first nozzle hole 42 in the cylindrical section 36. This spinner slot 33 is formed of a circular part 44*a* around the nozzle hole 42, an upper longitudinal extension part 44*b* extending upwardly from one upper end of the circular part 44*a* to a height equal to that of the second hole 21 of the plug unit 10, and a lower longitudinal extension part 44*c* extending downwardly from the other lower end of the circular part 44*a* to a level equal to that of the first hole 20 in such a manner that the interval between the extension ends of the upper and lower extension parts 44*b* and 44*c* is equal to that between the second hole 21 and the first hole 20. Hence, the spinner slot 44 communicates with the first nozzle hole 42 corresponding to the holes 20. 21 in the rotary attitude of the nozzle unit 35 with respect to the plug unit 10.

A guide slot 45 extending upwardly to the nozzle hole 43 as the upper end and downwardly to the height of the third hole 33 of the inner plug 10 is further formed around the second nozzle hole 43. When the nozzle unit 35 is rotated in a predetermined rotary attitude, the third hole 22 can communicate with the second nozzle hole 43.

Further, the first, second and third holes 20, 21 and 22 are disposed with respect to the spinner slot 44 and the guide slot 45 so that the third hole 22 is sealed due to the intimate contact of the sealing strips 34 with the inner peripheral surface of the cylindrical section 36 in the attitude that the first and second holes 20, 21 communicate with the first nozzle hole 42 through the spinner slot 44 and further that the first and second holes 20, 21 are sealed by the sealing strips 34 with the second nozzle hole 43 through the guide slot 45 due to the intimate contact of the sealing strips 34 with the inner peripheral surface of the cylindrical section 36 in the attitude that the third hole 22 communicates with the second nozzle hole 43 through the guide slot 45.

A pair of stopper portions 46 are longitudinally formed at the predetermined rear side positions on the outer peripheral surface of the cylindrical section 36, and a pair of engaging projections 47 are formed at the position slightly forward from the stopper portions 45.

Figure 6:
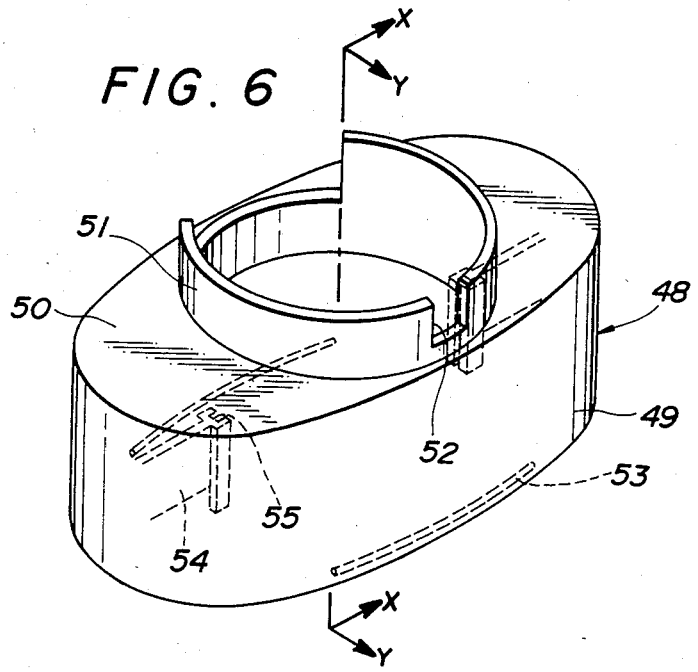
FIG. 6 is a perspective view of a cover unit of the sprayer cap of the invention.

Referring now to FIGS. 1 and 6, reference numeral 48 designates a cylindrical cover unit.

This cover unit 48 has a cylindrical mating portion 51 at the center of a top plate 50 at the upper end of an elliptical portion 49 substantially corresponding to the elliptical shape of the top wall 5 of a bottle-shaped container 1.

This mating portion 51 is cut out at the rear part thereof and has an inner diameter substantially equal to the outer diameter of the cylindrical section 36 of the nozzle unit 35. The mating portion 51 is also cut out with a window hole 52 at the front part thereof. Further, engaging strips 53 to be engaged with the engaging strips 7 of the container 1 are formed at the lower front and rear parts of the inner peripheral surface of the elliptical portion 49, reinforcing ribs 54 are projected from the elliptical portion 49 on the imaginary long-diameter line, an engaging lateral groove 55 is formed on the end face of the rib 54, and the outer strip 16 of the inner plug 10 is engaged in the groove 55.

In this manner, the cover unit 48 is engaged with the upper part of the container 1 in the state that: the inner plug 10 is associated in the container 1, placed at the lower end thereof on the stepped part 4, immovably associated with the container 1 in such a manner that the engaging strips 53 are engaged with the engaging strips 7 and the outer strip 16 is engaged in the groove 55, and associated as a sprayer cap by inserting the cylindrical section 36 of the nozzle unit 35 into the mating portion 51 from above and rotatably associating the nozzle unit 35 with respect to the inner plug 10.

In the associated state as described above, the lower end of the outer peripheral wall 39 of the nozzle unit 35 is disposed above the top plate 50 of the cover unit 48. The nozzle unit 35 can thus be rotated by holding the knurled sides 41, but since a pair of stopper portions 46 are formed at a predetermined interval on the rear part of the cylindrical section 36 of the nozzle unit 35, one stopper portion 46 makes contact with the one rear part of the mating portion 51 of the cover unit 50 in a predetermined rotary attitude, and the rotating limit can be set.

Figure 7A:
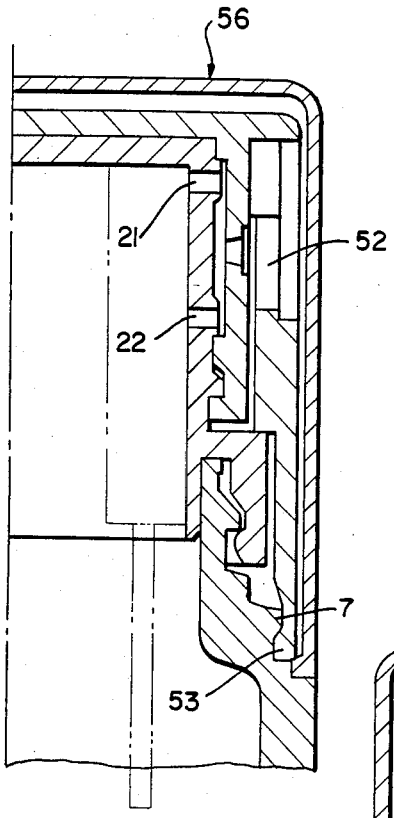
FIG. 7*a* is a sectional view showing the associated state of the respective components of the sprayer cap of the invention taken along the short axis line Y—Y of FIG. 6.
Figure 7B:
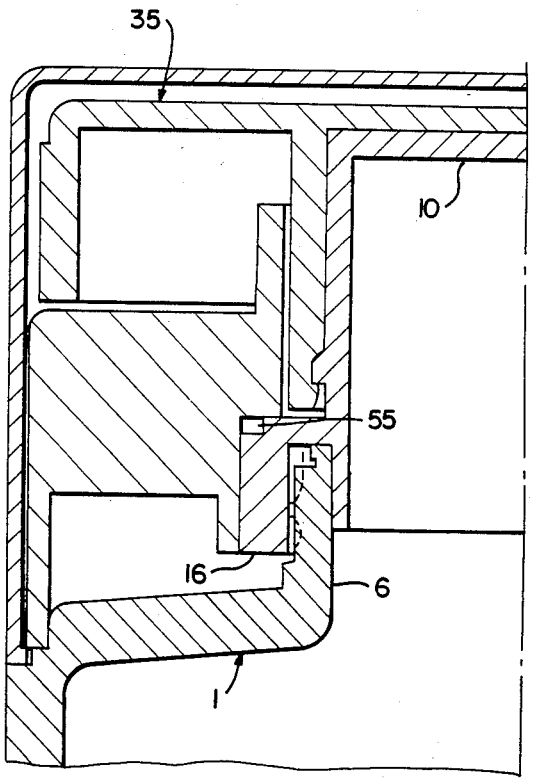
FIG. 7*b* is an sectional view showing the associated state of the respective components along the long axis line X—X of FIG. 6.

Referring to FIG. 7, reference numeral 56 designates a cap to be engaged with the upper end of the container 1 associated with the above-described sprayer cap.

The sprayer cap thus constructed as described above can be used in the following manner according to the present invention.

Figure 8A:
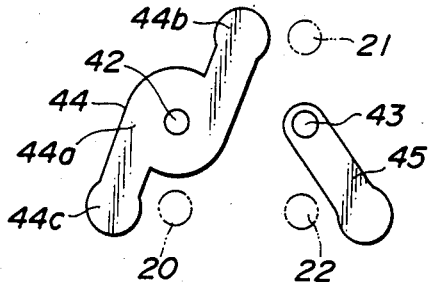
FIGS. 8*a*, 8*b* and 8*c* are explanatory views showing the positonal relationship and the holes of the inner plug and the nozzle holes of the nozzle unit.
Figure 8B:
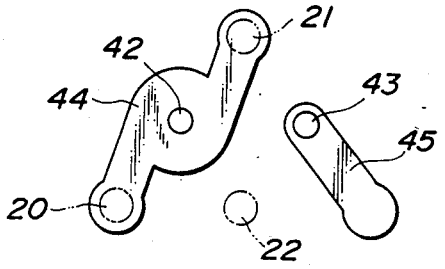
Figure 8C:
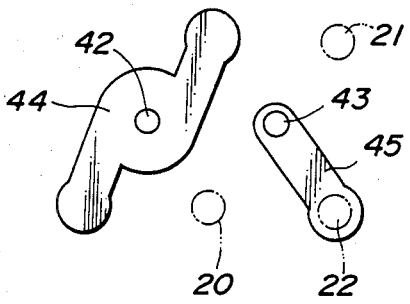
Figure 9A:
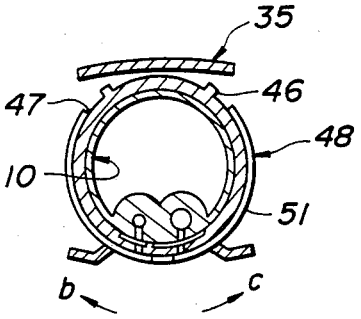
FIGS. 9*a*, 9*b*, 9*c* are lateral sectional views showing the positional relationship of FIGS. 8*a*, 8*b* and 8*c*.
Figure 9B:
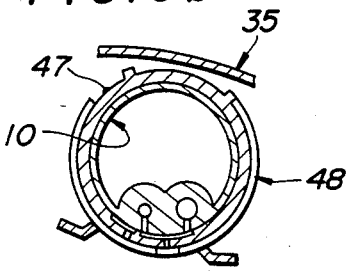
Figure 9C:
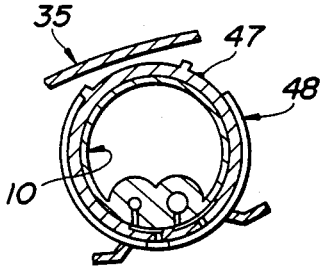

Reference is made to the FIGS. 8*a*, 8*b* and 8*c*, showing the positional relationship between the holes 20, 21 and 22 of the inner plug 10 and the nozzle holes 42, 43 of the nozzle unit 35, and to FIGS. 9*a*, and 9*b* and 9*c*, showing in irregular sections the positional relationship therebetween in a plane.

In FIGS. 8*a* and 9*a*, an unused state is shown in which liquid is not sprayed from the sprayer cap, since the sealing strips 34 of the holes 20, 21 and 22 of the plug 10 are intimately contacted with the inner periphery of the cylindrical section 36 of the nozzle unit 35. The holes 20, 21 and 22 are sealed or blocked, and since the engaging projections 47 of the nozzle unit 35 are respectively contacted with the rear part of the mating portion 51 of the cover unit 48 in this position, the nozzle unit 35 may not be accidentally rotated, thereby holding the unused state.

FIGS. 8*b* and 9*b* show the nozzle unit 35 rotated in a direction designated by an arrow (b) over the engaging projections 47 from the above state. The spinner slot 44 of the nozzle unit 45 communicates oppositely with the first and second holes 20 and 21 of the plug 10 at the rotary limit that one stopper portion 46 makes contact with the one rear part of the mating portion 51, and the first nozzle 42 is exposed from the window hole 52. When the container body 2 is then pressed to increase the internal pressure in the body 2, liquid in the container 1 is lifted through the pipe 24 into the first cylindrical portion 18 of the plug 35, fed from the first hole 20 into one lower extension 44*c* of the spinner slot 44, and the air in the container 1 is fed from the second cylindrical portion 19 into the other upper extension 44*b* of the spinner slot 44 through the second hole 21, and sprayed from the first nozzle hole 42.

In the state that the container 1 is erected vertically, the ball valve 30 in the first valve chamber 26 is disposed on the check valve seat 29, the ball valve 30 is lifted by the flow of the liquid from the pipe 24, but when pressing of the container body 2 is stopped, the ball valve 30 is simultaneously returned onto the check valve seat 29, and the upper end of the pipe 24 is sealed. Accordingly, the liquid in the pipe 24 does not drop downwardly, but is immediately fed to the first hole 20 by next pressing the container body 2. In other words, the liquid always stands by in the vicinity of the first hole 20, the spraying operation can be immediately provided, and it is not necessary to largely deform the container body 2.

When the container 1 is excessively inclined in the spraying condition, the liquid flows from the second cylindrical portion 19 to the second hole 21, and it might be expected that the spraying action cannot be obtained. However, according to the present invention, the ball valves 30, 33 in the valve chambers 26, 27 are respectively rolled to the blocking valve seats 28, 31 of the upper end, thereby stopping exhausting the liquid from the container 1.

In FIGS. 8*b* and 9*b*, the third hole 22 is sealed or blocked by the inner peripheral surface of the nozzle unit 35.

FIGS. 8*c* and 9*c* show the nozzle unit 35 rotated in a direction designated by an arrow (c). In this case, the third hole 22 of the plug 10 communicates oppositely with the extension end of the guide slot 45 of the nozzle unit 35 in the rotary limit that the other stopper portion 46 makes contact with the other rear part of the mating portion 51.

Therefore, since the interior and the exterior of the container 1 communicate with each other through the third hole 22, the guide slot 45 and the second nozzle hole 43, when the container body 2 is pressed after the container 1 is disposed upside down, liquid is streamed from the third hole 22 through the above-described route.

The ball valves 30, 33 are respectively disposed at the blocking valve seats 28, 31 in the inverted upside down attitude of the container 1, and the first and second holes 20, 22 are blocked by the peripheral surface of the nozzle unit 35.

Figure 10A:
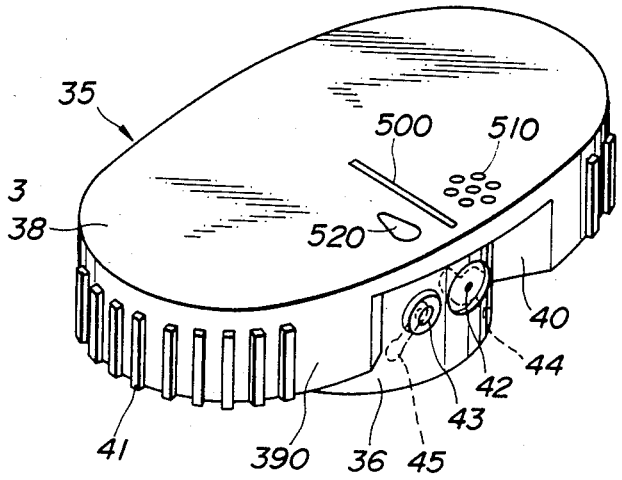
FIGS. 10*a* and 10*b* are perspective views of a modified example of the nozzle unit of the invention.
Figure 10B:
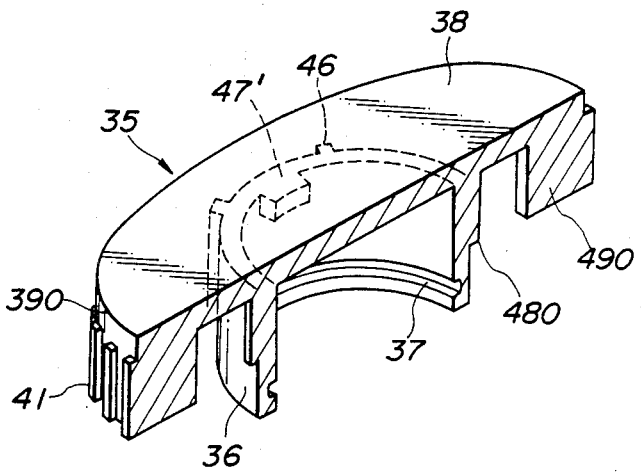

Referring now to FIGS. 10*a*, 10*b*, 11, 12 and 13*a*, 13*b*, 13*c*, modified examples of a nozzle unit 35 and a cover unit 48 are shown. As shown in FIGS. 10*a* and 10*b*, a pair of stopper portions 46 are longitudinally formed at predetermined positions of the rear part of the outer peripheral surface of the cylindrical section 36 of the nozzle unit 35, engaging projections 47' to be movably engaged within a cut-out portion 340 at the upper end of the inner plug 10 are projected at the intermediate positions of the stopper portions 46 from the upper rear part of the cylindrical section 36, engaging longitudinal strips 480 are formed at both right and left side positions on the outer surface of the cylindrical section 36, and engaging tongues 490 radially projecting toward the center in a predetermined width are projected from the upper positions on the long-diameter line in the outer peripheral wall 39.

A standby line pattern 500 which shows the center between the nozzle holes 42 and 43 is embossed directly above the cut-out portion 40 on the upper surface of the top plate 38, a spraying pattern 510 is embossed on the first nozzle hole 42 side of the pattern 500, and a stream pattern 520 is embossed on the second nozzle hole 43 side.

Figure 11:
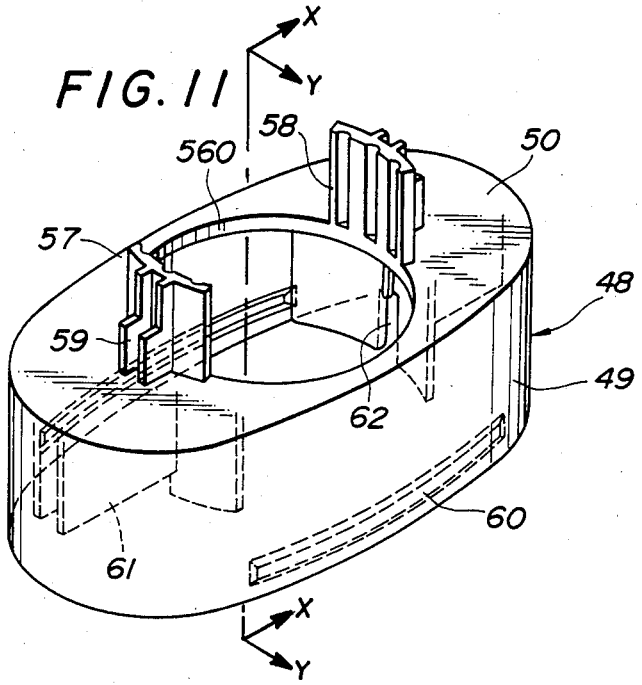
FIG. 11 is a perspective view of the modified example of the cover unit of the invention.
Figure 12A:
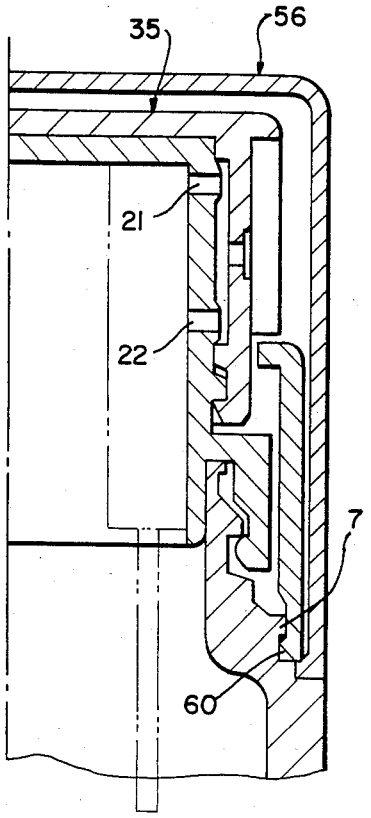
FIG. 12*a* is a sectional view showing the associated state of the nozzle unit and the cover unit in FIGS. 10 and 11 along the short axis line Y—Y of FIG. 11.
Figure 12B:
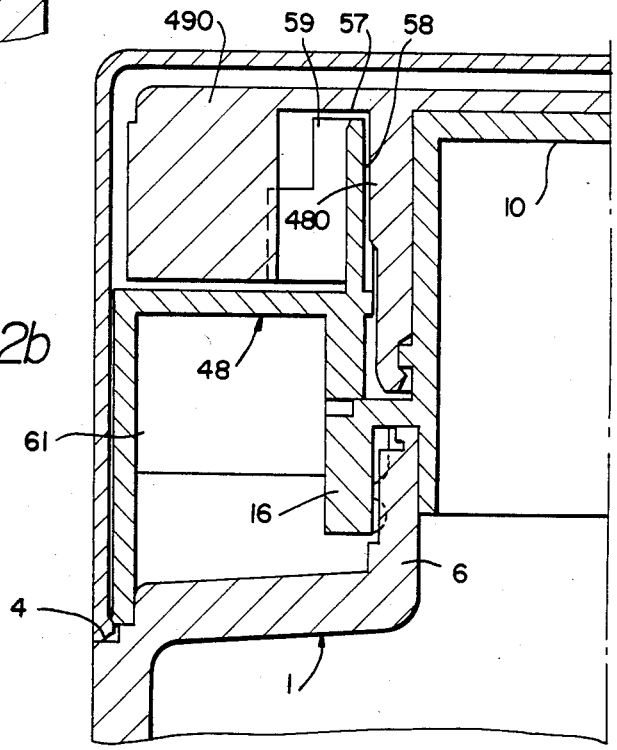
FIG. 12*b* is a sectional view showing an associated state of the nozzle unit and cover unit in FIGS. 10 and 11 along the long axis line X—X of FIG. 11.

As particularly shown in FIG. 11, an elliptical cylindrical cover unit 48 is perforated with a hole 560 having a diameter substantially equal to the outer diameter of the cylindrical section 36 of the nozzle unit 35 at the center of the top plate 50 of the upper end of the elliptical portion 49 substantially corresponding to the elliptical shape of the top wall 5 of the bottle-shaped container 1, and a pair of mating pieces 57 are erected from the positions along the hole 56 on the long-diameter line of the top plate 50.

When the cover unit 48 and the nozzle unit 35 are associated, the mating pieces 57 which make plane contact at the inner surface with both side outer surfaces of the cylindrical section 36 of the nozzle unit 35 are respectively formed with three engaging longitudinal grooves 58 to be engaged with the engaging strips 480 of the cylindrical section 36 on the inner surface at a predetermined interval, and a pair of engaging strips 59 are projected in a predetermined projecting width at a predetermined interval to be lightly engaged at the ends with the engaging tongues 490 of the nozzle unit 35. Further, engaging strips 60 to be engaged with the engaging strips 7 of the container 1 are formed at the lower front and rear ends of the inner peripheral surface of the elliptical portion 49, a pair of reinforcing ribs 61 are projected on the imaginary long-diameter line in the elliptical portion 49, engaging grooves 62 are formed at the ends, and the outer strips 16 of the plug 10 are engaged within the grooves 62.

As described above, the cover unit 48 is engaged with the upper end of the bottle-shaped container 1 in the state that the plug 10 is associated with the container 1, placed at the lower end thereof on the stepped part 4, the strips 60 are engaged with the strips 7, the outer strips 16 are engaged with the grooves 62 to be immovably associated therewith, and the upper end of the cylindrical section 36 of the nozzle unit 35 is inserted into the groove 62 to rotatably associate the nozzle unit 35 with the plug 10, thereby associating the resultant sprayer cap.

In the above-described associated state, the lower end of the outer peripheral wall 39 of the nozzle unit 35 is disposed above the top plate 50 of the cover unit 48, the nozzle unit 35 can be accordingly rotated by holding the knurled sides 50, but since a pair of stopper portions 46 are formed at an interval on the rear part of the cylindrical section 36 of the nozzle unit 35, the rear part of the one mating piece 57 of the cover unit 48 makes contact with the one stopper portion 46 in the prescribed rotary attitude, thereby setting the rotary limit.

This rotary limit can be also set by bringing the projections 47' formed on the upper rear part of the cylindrical section 36 of the nozzle unit 35 into contact with the end of the cut-out portion 340 of the upper rear part of the plug 10.

Each of the strips 480 of the cylindrical section 36 of the nozzle unit 35 is engaged with the central groove 58 of the three grooves 58 on the inner surface of the mating pieces 57 of the cover unit 48 in that the nozzle unit 35 and cover unit 48 coincide with each other in the long-diameter line in the above-described associated state, and the end of the tongues 490 formed on the inner surface of the outer peripheral wall 39 of the nozzle unit 35 is disposed between the ends of a pair of the strips 59 on the outer surfaces of the mating pieces 57 in a stable attitude. When the nozzle unit 35 is rotated in one direction in this state, the one tongue 490 elastically deforms one strip 59 to override the strip 59, the strip 480 is simultaneously engaged with the first groove 58 on one side of the central groove 58 into a stable attitude, thereby allowing the nozzle unit 35 to be rotated to the limit. Similarly, in the reverse rotation of the nozzle unit 35, the tongue 490 overrides the other strip 59 and the strip 480 is engaged with the second groove 58 on the opposite side of the central groove.

Figure 13A:
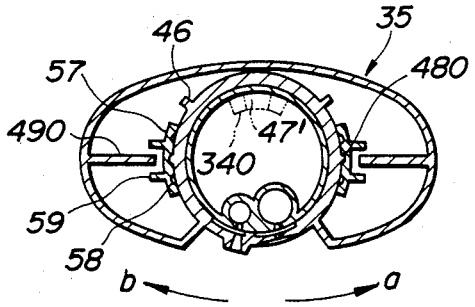
FIGS. 13*a*, 13*b* and 13*c* are lateral sectional views showing the positional relationship between the holes of the inner plug and the nozzle holes of the nozzle unit in the modified example of the invention.

Referring particularly to FIGS. 8*a* and 13*a*, showing the standby state for not injecting the liquid, the holes 20, 21 and 22 of the inner plug 10 are sealed in intimate contact with the inner peripheral surface of the cylindrical section 36 of the nozzle unit 35, the strips 480 are engaged with the central groove 58, and the tongue 490 is engaged between a pair of strips 59. Thus, irregular rotation of the nozzle unit 35 can be prevented, the standby state is maintained, and the standby pattern 500 on the upper surface of the nozzle unit 35 is directed forward, thereby allowing an operator to judge the state of the sprayer cap.

Figure 13B:
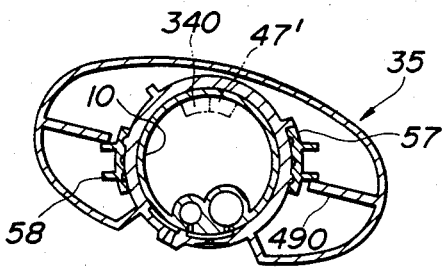

FIGS. 8*b* and 13*b* show the attitude that the tongue 490 overrides the one strip 59 to rotate the nozzle unit 35 in a direction designated by an arrow (b) from the above state. In this case, one stopper portion 49 makes contact with the rear part of the one mating piece 57, the projections 47' of the nozzle unit 35 make contact with one end of the cutout portion 340 of the plug 10, the spinner slot 44 of the nozzle unit 35 communicates oppositely with the first and second holes 20, 21 of the plug 10 at the rotary limit that the strip 480 is engaged with the first one of the grooves 58, and the first nozzle hole 42 and the sprayer pattern 51 are directed forwardly.

When the container body 2 of the bottle-shaped container 1 is then pressed to increase the internal pressure in the container 1, the liquid in the container 1 is lifted through the pipe 24 to the first cylindrical portion 18 of the plug 10, fed from the first hole 20 into one lower extension 44*c* of the spinner slot 44, the air in the container 1 is fed from the second cylindrical portion 19 into the other upper extension 44*b* through the second hole 21, and sprayed from the first nozzle hole 42.

Figure 13C:
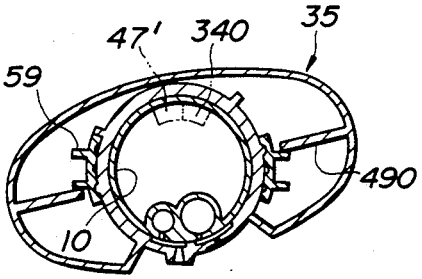

In FIGS. 8*c* and 13*c*, the nozzle unit 35 is rotated in a direction designated by an arrow (c), the other stopper portion 46 makes contact with the rear part of the other mating piece 57, the projection 47' of the nozzle unit 35 makes contact with the other end of the cutout portion 340 of the plug 10, the third hole 22 of the plug 10 communicates oppositely with the extension end of the guide slot 45 of the nozzle unit 35 in the rotary limit that the strip 480 is engaged with the other second groove 58, and the second nozzle hole 43 and the stream pattern 52 are directed forwardly.

As described above, the interior and the exterior of the bottle-shaped container 1 communicate with each other through the third hole 22, the guide slot 45 and the second nozzle hole 43. Thus, when the container body 2 is pressed after the container 1 is inverted or turned upside down, the liquid is streamed from the third hole 22 through the above-described route.

In the above inverted state of the container 1, the valves 30, 22 are respectively disposed at the blocking valve seats 28, 31, and the first and second holes 20, 21 are blocked by the inner peripheral surface of the nozzle unit 35.

As described above according to the present invention, the sprayer cap structure of the invention mainly consists of the inner plug 10, the nozzle unit 35 and the cover unit 48, and is formed with a pair of valve chambers 23*a*, 23*b* in the plug 10. Therefore, when the nozzle unit 35 is rotated with respect to the plug 10, the operation can be readily switched between the spraying state and the streaming state.

In the invention, the liquid in the bottle-shaped container 1 is always disposed in the vicinity of the first hole 20 for spraying by means of the valve 29, and can be accordingly sprayed immediately, and even when the container is excessively inclined, the liquid is prevented from being exhausted, thereby eliminating the insufficient spraying state.

According to the invention, the spraying state and the streaming state can be simply switched by rotating the nozzle unit 35 in the predetermined amount, and the positions of the rotary limit and the standby state can be defined. Therefore, the sprayer cap of the invention can be easily used, and particularly under the switching conditions, a light impact of elastic deformation by the override of the tongue 490 to the strip 59 is transmitted to operator's hand, thereby reliably operating the sprayer cap while providing the user with a sensation that the sprayer cap is positioned properly.

According further to the sprayer cap structure of the present invention, the spraying operation and the streaming operation can be extremely simply and reliably performed, the switching between the both operations can be readily carried out and yet is not accidentally switched, thereby facilitating the construction and the operation of the sprayer cap.

Figure 14:
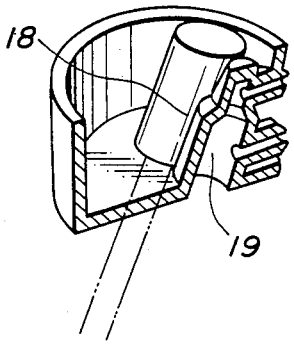
FIG. 14 is a partial perspective view of the modified example in the internal structure of the innver plug of the invention.

FIG. 14 shows a modified example of an inner plug in which the cylindrical portions 18 and 19 are inclined forwardly at the upper ends thereof. In such a structure, when the bottle-shaped container is excessively inclined in the spraying state, the ball valve in the cylinder can be smoothly rolled to block the spraying hole and the air hole, thereby blocking the further injection of the liquid. Therefore, the liquid is not streamed under the spraying condition.

What is claimed is:

1. A sprayer cap structure associated with a neck portion of a soft synthetic resin bottle-shaped container, said sprayer cap structure comprising:

an inner plug having a top wall and a cylindrical section integrally formed with adjacent first and second hollow cylindrical portions; said cylindrical section being perforated with a first hole communicating with said first cylindrical portion and with the bottom of the container through a pipe engaged with a lower end of the first cylindrical portion; said first cylindrical portion being formed with a first valve chamber provided with a blocking valve at an upper position of said first valve chamber, a first ball valve located within said first valve chamber, and a check valve at a lower position of said first valve chamber; said cylindrical section being perforated with a second hole and a third hole communicating with said second cylindrical portion and spaced longitudinally therefrom, said second cylindrical portion being formed with a second valve chamber under the second hole, said second valve chamber being provided with a blocking valve and a second ball valve at an upper position of the second valve chamber;

a nozzle unit formed with a top wall and an inner cylindrical section rotatably and non-telescopically associated with the inner plug; said inner cylindrical section having a spinner slot selectively communicating with the first and second holes of the inner plug, a first nozzle hole substantially at the center of the spinner slot of the inner cylindrical section, and a second nozzle hole capable of communicating with the third hole of the inner plug adjacent to the first nozzle hole; and a cylindrical cover unit having a lower end immovably associated with the container body, said cover unit sheathing the inner cylindrical section of the nozzle unit, and formed with a window hole for exposing the first and second nozzle holes of the nozzle unit;

wherein the peripheries of the first, second and third holes on the outer peripheral wall of the inner plug are intimately contacted with the inner peripheral surface of the inner cylindrical section of the nozzle unit.

2. The sprayer cap structure according to claim 1, wherein the container body of said container is formed of a material elastically deformable by an external force.

3. The sprayer cap structure according to claim 1, wherein the neck portion of said container is erected on the upper end of said container body in a short cylindrical shape, undercut outer threads are circumferentially formed on the outer central peripheral surface of said neck portion, and a pair of engaging longitudinal strips are formed on the radial line of said neck portion, said strips having a length substantially equal to the height of said threads on said neck portion.

4. The sprayer cap structure according to claim 1, wherein said inner plug is formed in a top-walled cylindrical shape immovably associated with the neck portion.

5. The sprayer cap structure according to claim 1, wherein the outer diameter of the cylindrical section of said inner plug is substantially equal to the inner diameter of said neck portion, the neck portion being provided with undercut threads; an outer cylindrical section having undercut inner threads and an inner diameter substantially equal to the outer diameter of the neck portion is suspended integrally from the outer periphery of the cylindrical section through a collar; said undercut inner threads are circumferentially formed on the lower inner peripheral end of the cylindrical section and engage said inner threads of the neck portion; and engaging longitudinal stopper grooves are formed in the inner threads.

6. The sprayer cap structure according to claim 5, wherein longitudinal outer strips are formed at two positions corresponding to the engaging grooves on the outer peripheral surface of the cylindrical section, and outer peripheral threads are formed substantially at the upper position of the collar on the outer periphery of the cylindrical section.

7. The sprayer cap structure according to claim 1, wherein said first and second cylindrical portions are longitudinally disposed in said inner plug, each of said first and second cylindrical portions having a center, said first hole is perforated at substantially the center of the first longitudinal cylindrical portion and extends through the cylindrical section, said second hole is perforated at the upper end of the second longitudinal cylindrical portion and extends through the cylindrical section, and said third hole is spaced downwardly from said second hole and located at a position having the same height as the first hole and spaced therefrom in a circumferential direction, said third hole being perforated through said cylindrical section.

8. The sprayer cap structure according to claim 1, further comprising a valve cylinder consisting of a pair of first and second cylindrical bores, each of which is commonly engaged intimately at a lower position of the first and second cylindrical portions, respectively, and a pipe is engaged with the lower end of the first bore associated with the first cylindrical portion.

9. The sprayer cap structure according to claim 8, wherein an upper end of said first valve chamber is provided with a block valve seat at an upper end of the first cylindrical bore of said valve cylinder, a check valve seat at an upper end of the valve cylinder is inserted into the lower part of the first bore and defines a lower end of the valve chamber, a ball valve is contained in the valve chamber; and wherein said second valve chamber is provided with a blocking valve seat below the second hole in the upper part of the second cylindrical portion and a holding portion at the upper end of the second bore of the valve cylinder, and a ball valve is contained therebetween.

10. The sprayer cap structure according to claim 1, wherein sealing strips are respectively formed at the peripheries of the first hole, second hole, and third hole of the outer peripheral surface of the cylindrical section of said plug.

11. The sprayer cap structure according to claim 1, wherein said first cylindrical portion is longer than the second cylindrical portion, a valve cylinder is associated in the first cylindrical portion, said valve cylinder including a cylindrical portion intimately engaged within the first cylindrical portion, and a holding portion movably engaged within the lower end of the second cylindrical portion and extending to the lower end of said cylindrical portion, said first valve chamber is formed in the first cylindrical portion, and the second valve chamber is formed in the second cylindrical portion.

12. The sprayer cap structure according to claim 11, wherein said first valve chamber is formed with a blocking valve seat at a position below the first hole in the cylindrical portion, a valve seat cylindrical portion is engaged within the lower end of said cylindrical portion, a check valve seat is formed in the upper end of said valve seat cylindrical portion, a ball valve is arranged between said blocking valve seat and said check valve seat, and said second valve chamber is formed in the second cylindrical portion, a blocking valve seat is formed substantially at a position below the second hole, and a ball valve is contained between the blocking valve seat and the end of the holding portion disposed at a position below the third hole.

13. The sprayer cap structure according to claim 6, wherein said nozzle unit has a top plate and a top-walled inner cylindrical section having an inner diameter substantially equal to the outer diameter of the plug on the lower central surface of the top plate and suspended integrally therefrom, an inner peripheral groove is formed on the inner peripheral wall of the cylindrical section, the outer threads formed on the plug are engaged with the groove, thereby rotatably and non-telescopically associating the nozzle unit with the plug.

14. The sprayer cap structure according to claim 13, wherein an outer peripheral wall is suspended from the peripheral edge of said top plate, and the front part of the outer peripheral wall is cut out to form a cutout portion.

15. The sprayer cap structure according to claim 14, wherein said first nozzle hole and said second nozzle hole are perforated at a predetermined interval and at the same height as the front part of the cylindrical section exposed by the cutout portion of the outer peripheral wall of said nozzle unit.

16. The sprayer cap structure according to claim 1, wherein the positions of said first nozzle hole and second nozzle hole are approximately intermediate between the second hole and the third hole of said plug when the the nozzle unit is associated with said plug.

17. The sprayer cap structure to claim 1, wherein said spinner slot consists of a circular part around the nozzle hole, an upper longitudinal extension part extending upwardly from one upper end of the circular part to a height substantially equal to that of the second hole of the plug, and a lower longitudinal extension part extending downwardly from an opposite lower end of the circular part to a height substantially equal to that of the first hole in such a manner that the interval between the extension ends of the upper and lower extension parts is substantially equal to that between the second hole and the first hole.

18. The sprayer cap structure according to claim 13, wherein a pair of stopper portions are longitudinally formed at predetermined locations on a rear side of the outer peripheral surface of the cylindrical section, and a pair of engaging projections are formed at a position substantially forward from the stopper portion.

19. The sprayer cap structure according to claim 18, wherein said top wall of the container and said cover unit have an elliptical shape, said cover unit includes an upstanding cylindrical mating portion at the center of a top plate for the cover unit, said cover unit having suspended from said top plate an elliptical portion having a shape substantially corresponding to the elliptical shape of the top wall of the container, the mating portion has an inner diameter substantially equal to the outer diameter of the cylindrical section of the nozzle, and is cut with a window hole at a front part thereof and cut at a rear portion thereof to receive said stopper portions of said cylindrical section.

20. The sprayer cap structure according to claim 19, wherein reinforcing ribs project from the elliptical portion along a long-diameter axis of said elliptical portion, an engaging lateral groove is formed on the end face of the rib, and the outer strip of the inner plug is engaged in the groove.

21. The sprayer cap structure according to claim 1, wherein a pair of stopper portions are longitudinally formed at predetermined positions on the rear part of the outer peripheral surface of the cylindrical section of the nozzle unit, engaging projections to be movably engaged within a cutout portion at the upper end of the inner plug project from the intermediate positions of the stopper portions from the upper rear part of the cylindrical section, engaging longitudinal strips are formed at both side positions on the outer surface of the cylindrical section, and engaging tongues radially project toward the center in a predetermined width from the upper positions on the outer peripheral wall.

22. The sprayer cap structure according to claim 21, wherein the top wall of the container has an elliptical shape, an elliptical cover unit has a top plate 50 centrally perforated with a hole having a diameter substantially equal to the outer diameter of the cylindrical section of the nozzle unit, said top plate having a depending elliptical portion substantially corresponding to the elliptical shape of the top wall of the container, and a pair of mating pieces are respectively formed with a plurality of engaging longitudinal grooves for engagement with engaging strips located at a predetermined interval on the inner surface of the cylindrical section, and a pair of engaging strips having a predetermined width and located at a predetermined interval project from the mating pieces for selective engagement with the engaging tongues of the nozzle unit.

23. The sprayer cap structure according to claim 1, wherein the upper ends of the first and second cylindrical portions are inclined forwardly.

* * * * *